US009309024B2

(12) United States Patent
Hammerschmidt et al.

(10) Patent No.: US 9,309,024 B2
(45) Date of Patent: Apr. 12, 2016

(54) PACKAGING ASSEMBLY

(75) Inventors: Christof Hammerschmidt, Wiesbaden (DE); Devin C. Ridgeway, Chula Vista, CA (US)

(73) Assignee: Sealed Air Corporation (US), Charlotte, NC (US)

( * ) Notice: Subject to any disclaimer, the term of this patent is extended or adjusted under 35 U.S.C. 154(b) by 501 days.

(21) Appl. No.: 13/416,463

(22) Filed: Mar. 9, 2012

(65) Prior Publication Data

US 2013/0233752 A1 Sep. 12, 2013

(51) Int. Cl.
*B65D 81/02* (2006.01)
*B65D 5/50* (2006.01)

(52) U.S. Cl.
CPC ..... *B65D 5/5028* (2013.01)

(58) Field of Classification Search
CPC ..... B65D 81/2076; B65D 81/264; B65D 21/062; A23L 1/31; A23L 1/317
USPC ..... 215/328, 327, 324, 305, 295
See application file for complete search history.

(56) References Cited

U.S. PATENT DOCUMENTS

| | | | |
|---|---|---|---|
| 2,251,283 | A | 8/1941 | Johnson |
| 3,347,445 | A | 10/1967 | Wood |
| 3,905,474 | A | 9/1975 | Haibara |
| 4,852,743 | A | 8/1989 | Ridgeway |
| 4,923,065 | A | 5/1990 | Ridgeway |
| 5,071,009 | A | 12/1991 | Ridgeway |
| 5,287,968 | A | 2/1994 | Ridgeway |
| 5,388,701 | A | 2/1995 | Ridgeway |
| 5,676,245 | A | 10/1997 | Jones |
| 5,678,695 | A | 10/1997 | Ridgeway et al. |
| 5,694,744 | A | 12/1997 | Jones |
| 5,857,612 | A | 1/1999 | Smith et al. |
| 5,893,462 | A | 4/1999 | Ridgeway |
| 5,894,932 | A | 4/1999 | Harding et al. |
| 6,010,006 | A | 1/2000 | Ridgeway et al. |
| 6,045,038 | A | 4/2000 | Smith et al. |
| 6,148,590 | A | 11/2000 | Ridgeway et al. |
| 6,148,591 | A | 11/2000 | Ridgeway et al. |
| 6,158,589 | A | 12/2000 | Smith et al. |
| 6,289,655 | B1 | 9/2001 | Ridgeway et al. |
| 6,302,274 | B1 | 10/2001 | Ridgeway |
| 6,311,844 | B1 | 11/2001 | Ridgeway et al. |
| 6,675,973 | B1 | 1/2004 | McDonald et al. |
| 6,899,229 | B2 | 5/2005 | Dennison et al. |
| 6,913,147 | B2 | 7/2005 | Mueller et al. |

(Continued)

FOREIGN PATENT DOCUMENTS

| | | |
|---|---|---|
| DE | 29921203 U1 | 2/2000 |
| FR | 2198458 A5 | 3/1974 |
| WO | WO 00/53499 | 9/2000 |

*Primary Examiner* — Anthony Stashick
*Assistant Examiner* — Raven Collins
(74) *Attorney, Agent, or Firm* — Daniel B. Ruble

(57) ABSTRACT

A packaging structure for restraining an object comprises a panel and a film. The panel comprises a platform portion, an end flap portion, and a hinge portion. The end flap portion is foldably connected to the platform portion along an end flap fold line. The hinge portion comprises top and bottom hinge sections foldably connected to each other along a first hinge fold line between the top and bottom hinge sections. The film extends across the end flap fold line and is attached to the end flap portion and is also attached to the panel outside of the end flap portion. The packaging structure is foldable to an engaged position in which the object may be restrained between the film and the platform portion of the panel.

19 Claims, 13 Drawing Sheets

(56) References Cited

U.S. PATENT DOCUMENTS

| | | | | |
|---|---|---|---|---|
| 6,942,101 | B2 | 9/2005 | Lofgren et al. | |
| 7,086,534 | B2 | 8/2006 | Roesel et al. | |
| 7,150,356 | B2 | 12/2006 | Lofgren et al. | |
| 7,232,054 | B2 * | 6/2007 | Yocum | 229/114 |
| 7,296,681 | B2 | 11/2007 | McDonald et al. | |
| 7,374,038 | B2 * | 5/2008 | Smalley | 206/175 |
| 7,753,209 | B2 | 7/2010 | McDonald et al. | |
| 7,882,956 | B2 | 2/2011 | McDonald et al. | |
| 2004/0108239 | A1 | 6/2004 | McDonald et al. | |
| 2006/0213803 | A1 * | 9/2006 | Saitou et al. | 206/583 |
| 2007/0251856 | A1 | 11/2007 | Zietlow | |
| 2011/0240515 | A1 | 10/2011 | Ridgeway | |

* cited by examiner

PACKAGING ASSEMBLY

The presently disclosed subject matter relates to a packaging assembly, for example, a packaging assembly to restrain a packaged object during shipment.

BACKGROUND

Protective packaging structures may be used to help protect a product during transport, for example, from physical shock, dust, and other contaminants. For example, a product may be enclosed in a box with additional packing materials (e.g., crumpled paper, air-filled plastic cushions, molded foam) to restrain the product movement inside the box and to cushion the product.

One type of packaging structure is known as "retention" packaging. In typical retention packaging, a product is retained between a film and a rigid backing frame to which the film is attached. Examples of retention packaging are described in more detail in U.S. Pat. Nos. 5,678,695; 5,893,462; 6,010,006; 6,148,590; 6,148,591; 6,289,655; and 6,311,844, each of which is incorporated herein in its entirety by reference.

While these retention structures provide a level of protection for the packaged object, there is room for improvement, for example, by enhancing the ability of the system to withstand shocks such as dropping, while minimizing the increased use of materials to provide the enhancement.

SUMMARY

One or more embodiments of the presently disclosed subject matter may address one or more of the aforementioned problems.

A packaging structure for restraining an object comprises a panel and a film. The panel comprises a platform portion, an end flap portion, and a hinge portion. The platform portion has a support surface for supporting the object. The end flap portion is foldably connected to the platform portion along an end flap fold line. The hinge portion comprises top and bottom hinge sections foldably connected to each other along a first hinge fold line between the top and bottom hinge sections. The hinge portion is bordered by (i) a second hinge fold line between the platform portion and the top hinge section, (ii) at least one top hinge cut line between the platform portion and the top hinge section and extending from the end flap fold line to the second hinge fold line, (iii) a third hinge fold line between the end flap portion and the bottom hinge section, and (iv) at least one bottom hinge cut line between the end flap portion and the bottom hinge section and extending from the end flap fold line to the third hinge fold line.

The film extends across the end flap fold line and is attached to the end flap portion and is attached to the panel outside of the end flap portion. The packaging structure is foldable to an engaged position having (a) the end flap portion folded along the end flap fold line away from the support surface of the platform portion to define an acute angle between the platform portion and the end flap portion and (b) the hinge portion folded along the first, second, and third hinge fold lines to separate the top hinge section and the platform portion along the at least one top hinge cut line, separate the bottom hinge section and the end flap portion along the at least one bottom hinge cut line, and extend the top and bottom hinge sections within the acute angle between the platform portion and the end flap portion.

In the engaged position, it is believed that the hinge functions as a spring to provide an enhanced resistance to, and/or a dampening of compressive or drop forces generated on a packaging assembly that incorporates the packaging structure. In some embodiments, this attribute may be provided to the packaging structure without using additional materials beyond that normally provided for the retention structure.

These and other objects, advantages, and features of the various embodiments of the presently disclosed subject matter will be more readily understood and appreciated by reference to the detailed description and the drawings.

Various aspects of the subject matter disclosed herein are described with reference to the drawings. For purposes of simplicity, like numerals may be used to refer to like, similar, or corresponding elements of the various drawings. The drawings and detailed description are not intended to limit the claimed subject matter to the particular form disclosed. Rather, the intention is to cover all modifications, equivalents, and alternatives falling within the spirit and scope of the claimed subject matter.

DETAILED DESCRIPTION

The presently disclosed subject matter teaches several embodiments of a packaging structure for restraining an object, as well as a packaging assembly for holding the packaging structure within a box. The packaging structure comprises a panel and a film attached to the panel. The panel comprises at least one end flap and at least one hinge portion, as described below in more detail.

Packaging Structure

In an embodiment of the disclosed subject matter, panel 14 comprises a platform portion 18 having a support surface 20 for supporting the object 12 restrained by the packaging structure. (See, e.g., FIG. 5.) The panel comprises a substantially rigid, lightweight, foldable material, for example, one or more of any of the following materials: cellulosic-based materials (e.g., cardboard, corrugated cardboard, paperboard), plastic, and compressed foam. For example, panel 14 may comprise corrugated cardboard, for example, any of single-wall B-flute, C-flute, and/or E-flute corrugated cardboard, B/C double-wall corrugated cardboard, and/or E/B double-wall corrugated cardboard. The panel, and any of the panels and tray frames of the various embodiments described herein, may have an average thickness of, for example, at most, and/or at least, any of the following thicknesses: 0.03, 0.06, 0.12, 0.18, 0.25, 0.3, 0.4, and 0.5 inches.

Figure 1:
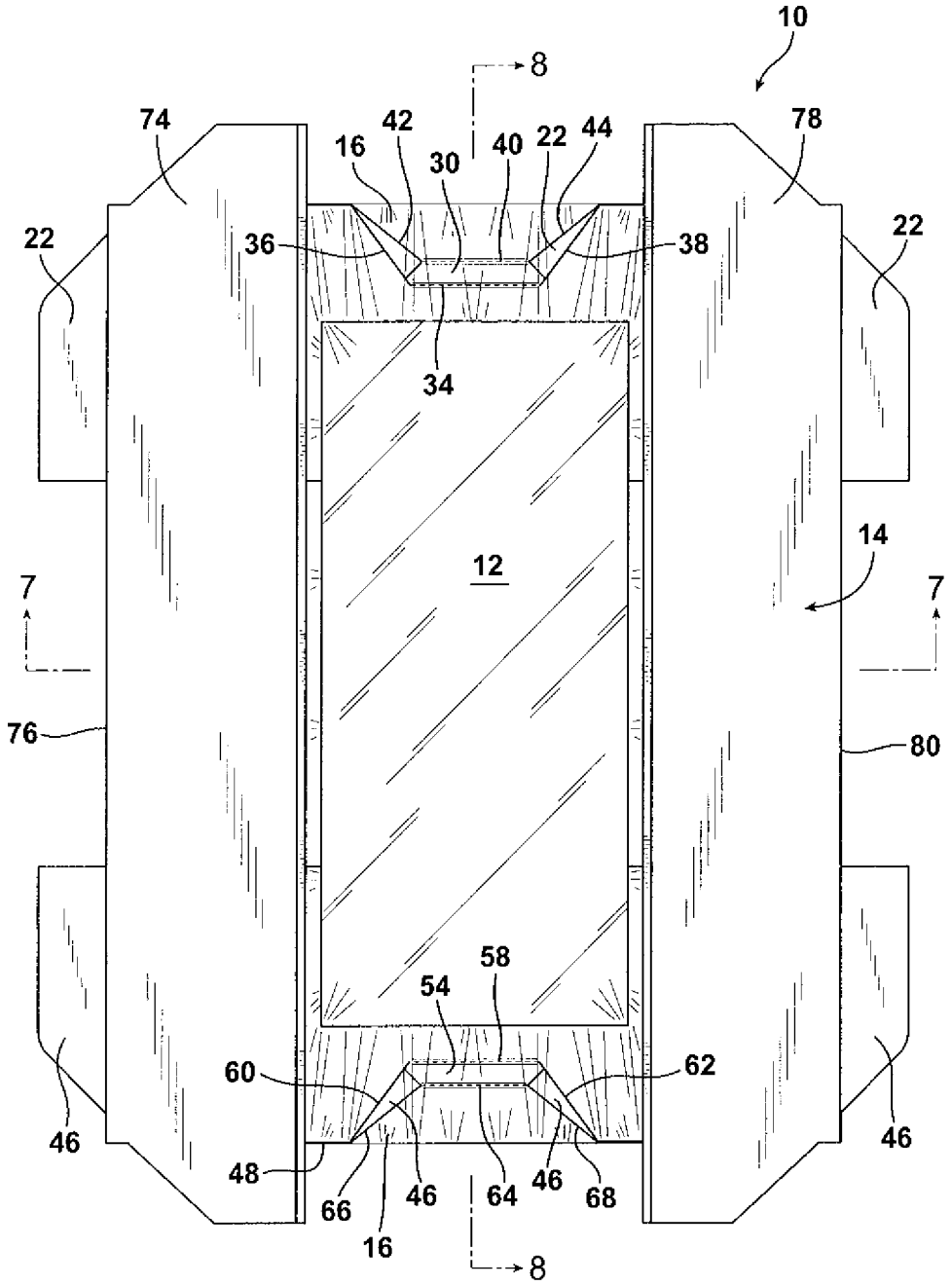
FIG. 1 is a representative top plan view of an embodiment of the packaging structure of the present disclosure in the engaged position.

The support surface 20 of the platform portion 18 may be provided by a substantially continuous platform portion, as illustrated in the attached drawings. Alternatively, the support surface of the platform portion may be discontinuous, for example where the platform portion comprises a film material or other material covering a window or other opening, such that the support surface is provided by the covering material of the platform portion, for example, as illustrated in U.S. Pat. No. 7,086,534 (e.g., FIG. 2); U.S. Pat. No. 6,302,274 (e.g., FIG. 1); and U.S. Pat. No. 5,388,701 (e.g., FIG. 1), and U.S. Patent App. Publ. No. 2011/0240515 A1, the entire disclosures of which are incorporated herein by reference.

The panel 14 comprises end flap portion 22 foldably connected to the platform portion 18 along an end flap fold line 24. The end flap fold line 24 is spaced from, and may be parallel to, an outer edge of the panel 14. A "fold line" as used herein (and as depicted in the drawings of the lay-flat, unfolded positions as a broken line) represents a line along which the panel may be creased, crimped, embossed, perforated, scored, or otherwise weakened so as to enhance the foldability of the panel, frame, or other material along the fold line. For example, end flap fold line 24 may include one or more through slits extending partially along its length, leaving a sufficient portion of the end flap fold line intact to securely join end flap portion 22 to the platform portion 18 of panel 14 so that end flap portion 22 is foldably connected to platform portion 18. The slits through the fold line may facilitate folding the first flap along the end flap fold line 24 by reducing the amount of panel material that has to be folded. As used herein, the terms such as "parallel" or "perpendicular" are not meant to indicate that the parallel or perpendicular orientation requires mathematical precision, but rather indicates a general orientation accepting moderate ranges of deviation from absolute parallel or perpendicular that are commonly acceptable within the meaning of these terms within the container-folding field.

Figure 2:
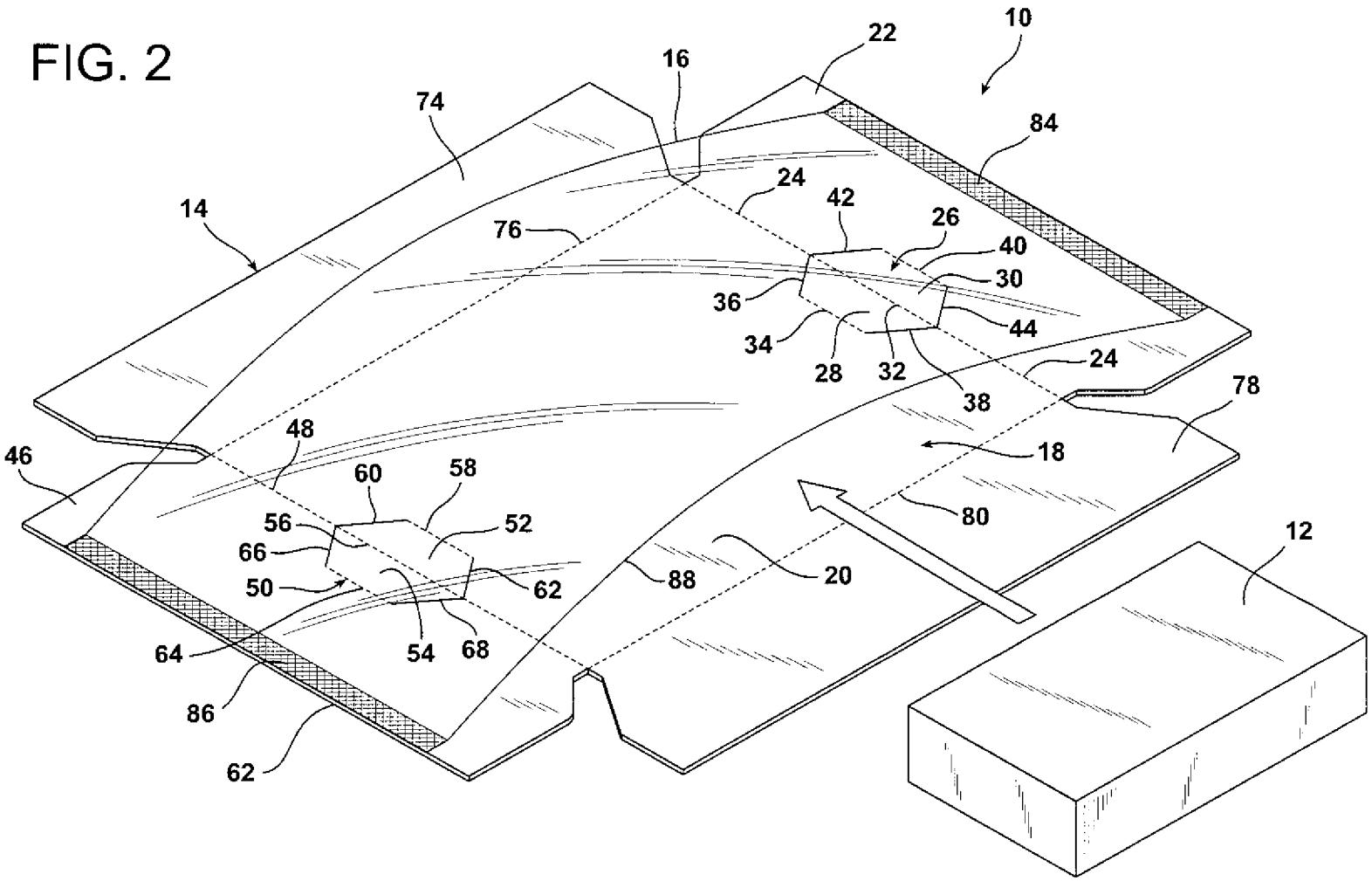
FIG. 2 is a representative perspective view of the packaging structure of FIG. 1 in the unfolded, lay-flat position before insertion of the object to be packaged.
Figure 3:
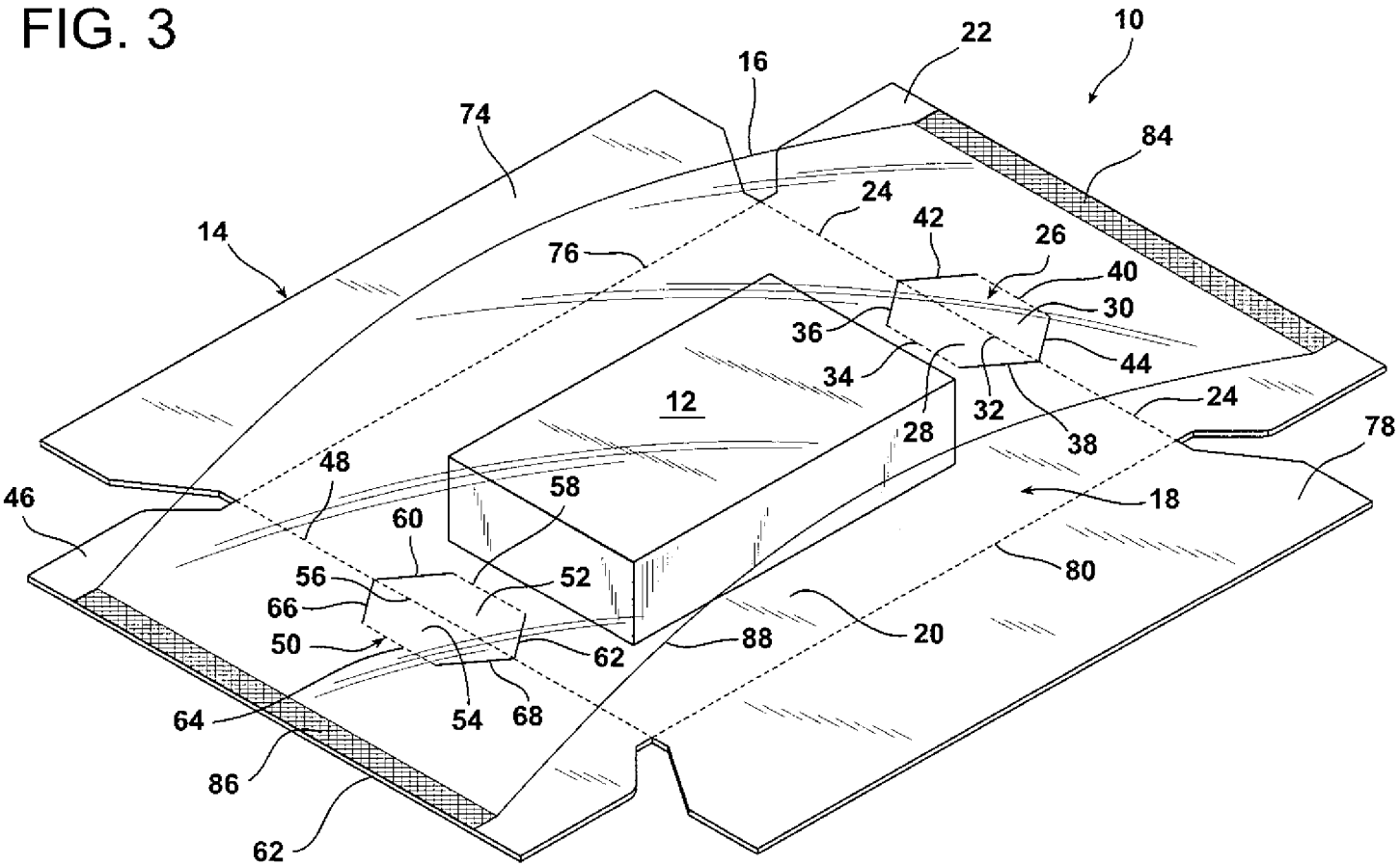
FIG. 3 is a representative perspective view of the packaging structure of FIG. 2 in the unfolded, lay-flat position after insertion of the object to be packaged.
Figure 4:
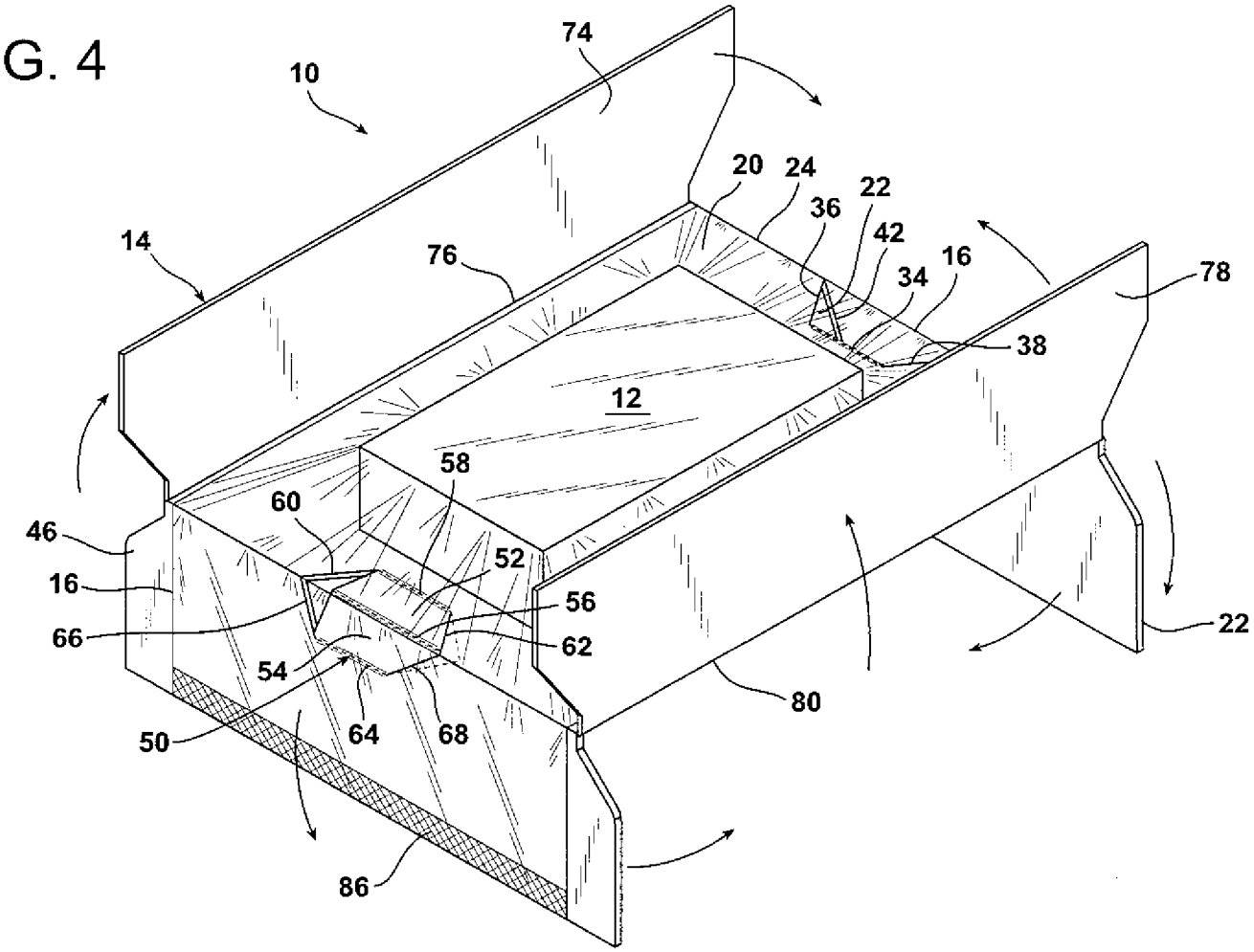
FIG. 4 is a representative perspective view of the packaging structure of FIG. 3 having the end and side flaps being moved toward the engaged position.

In reference to, for example, FIG. 2, the panel 14 comprises hinge portion 26 comprising top hinge section 28 and bottom hinge section 30 that are foldably connected to each other along first hinge fold line 32 between the top and bottom hinge sections. The hinge portion 26 is bordered by: (i) second hinge fold line 34 between platform portion 18 and top hinge section 28, (ii) at least one top hinge cut line between the platform portion 18 and the top hinge section 28 extending from the end flap fold line 24 to the second hinge fold line 34, for example, first top hinge cut line 36 and second top hinge cut line 38 (FIG. 2), (iii) third hinge fold line 40 between the end flap portion 22 and bottom hinge section 30, and (iv) at least one bottom hinge cut line between the end flap portion 22 and the bottom hinge section 30 extending from the end flap fold line 24 to the third hinge fold line 40, for example, first bottom hinge cut line 42 and second bottom hinge cut line 44 (FIG. 2). The second hinge fold line 34 may be oriented parallel to the first hinge fold line 32. The third hinge fold line 40 may be oriented parallel to the first hinge fold line 32.

A "cut line" as used herein (and as depicted in the drawings of the lay-flat, unfolded position as a solid line within the panel) represents a line along which the panel is either cut, or is otherwise perforated, scored, or weakened to such an extent, so that the panel is adapted to be easily detached (i.e., by hand) along the cut line. A cut line may be curved or straight.

The panel 14 may further comprise supplemental end flap portion 46 foldably connected to the platform portion 18 along supplemental end flap fold line 48. The supplemental end flap fold line 48 is oriented on an end of the platform portion 18 that is opposite the end flap fold line 24, and is spaced from, and may be parallel to, an outer edge of the panel 14.

The panel 14 may further comprise supplemental hinge portion 50 comprising supplemental top hinge section 52 and supplemental bottom hinge section 54 that are foldably connected to each other along supplemental first hinge fold line 56 between the supplemental top and supplemental bottom hinge sections. The supplemental hinge portion 50 is bordered by: (i) supplemental second hinge fold line 58 between platform portion 18 and supplemental top hinge section 52, (ii) at least one supplemental top hinge cut line between the platform portion 18 and the supplemental top hinge section 52 extending from the supplemental end flap fold line 48 to the supplemental second hinge fold line 58, for example, supplemental first top hinge cut line 60 and supplemental second top hinge cut line 62 (FIG. 2), (iii) supplemental third hinge fold line 64 between the supplemental end flap portion 46 and supplemental bottom hinge section 54, and (iv) at least one supplemental bottom hinge cut line between the supplemental end flap portion 46 and the supplemental bottom hinge section 54 extending from the supplemental end flap fold line 48 to the supplemental third hinge fold line 64, for example, supplemental first bottom hinge cut line 66 and supplemental second bottom hinge cut line 68 (FIG. 2).

The supplemental second hinge fold line 58 may be oriented parallel to the supplemental first hinge fold line 56. The supplemental third hinge fold line 64 may be oriented parallel to the supplemental first hinge fold line 56.

The panel 14 may further comprise side flap portion 74 and/or supplemental side flap portion 78. Side flap portion 74 is foldably connected to platform portion 18 by side flap fold line 76. The side flap fold line 76 is spaced from, and may be parallel to, an outer edge of the panel 14. Further, side flap fold line 76 may be oriented transverse to end flap fold line 24. Side flap portion 74 is foldably connected to platform portion 18 by side flap fold line 76. The supplemental side flap fold line 80 is spaced from, and may be parallel to, an outer edge of the panel 14. Further, supplemental side flap fold line 80 may be oriented on a side of the platform portion 18 that is opposite the side flap fold line 76, may be spaced from, and parallel to, an outer edge of panel 14, and may be oriented transverse to end flap fold line 24.

Film

Film 16 extends across end flap fold line 24. The film 16 is attached to end flap portion 24 along first attachment zone 84, which may be located adjacent the outer edge of the end flap portion. Film 16 is also attached outside of the end flap portion 24. For example, as illustrated in FIG. 2, the film 16 may extend across the supplemental end flap fold line 48 and attach to supplemental end flap portion 46 along second attachment zone 86, which may be located adjacent the outer edge of the supplemental end flap portion. The film 16 may have at least one edge portion 88 unconnected to platform portion 18, such that an object 12 may be inserted between the film 16 and the platform portion 18.

Film 16 may be attached to the panel 14, for example in the attachment zones, by one or more of any of the following: adhering (e.g., with hot melt adhesive), gluing, heat welding, ultrasonic welding, stapling, tacking, fastening, clipping (see, e.g., U.S. Pat. No. 5,694,744 to Jones, which is incorporated herein in its entirety by reference), anchoring (see, e.g., U.S. Patent Publication 2011/0240515 A1 FIGS. 17-19 and corresponding discussion, previously incorporated by reference), retaining and/or securing (see, e.g., U.S. Patent Application Publication 2004/0108239 A1 to McDonald et al. published Jun. 10, 2004, which is incorporated herein in its entirety by reference, and which discloses a sleeve having pockets or pouches for receiving a flap as shown in FIGS. 24-25 and related discussion therein). The films of any embodiments described herein may be attached by one or more of any of the attachment ways described herein.

The attachment zones 84, 86 may comprise adhesive 90 (FIG. 8) and may extend continuously (as shown, e.g., FIG. 2) or periodically (not illustrated) along the length of outer edges of the corresponding end flap portions. Useful types of adhesives for attaching films to panels are known to those of skill in the art, and of course depend on the composition of the materials to be adhered. For example, a polyurethane-based film may be adhered with a polyurethane-based adhesive, such as a water-borne aliphatic polyurethane dispersion.

FIGS. 9-10

In an embodiment of the hinge portion (referring to packaging structure 110 of FIGS. 9-10), hinge portion 112 comprises top and bottom hinge sections 28, 30 foldably connected to each other along first hinge fold line 32 between the top and bottom hinge sections. This embodiment is similar to the hinge portion 26 of FIG. 2, except that for the FIGS. 9-10 embodiment, bottom hinge section 30 comprises first ancillary portion 116 and second ancillary portion 118 foldably connected to each other along fourth hinge fold line 114. The fourth hinge fold line is between the first hinge fold line 32 and the third hinge fold line 40. The fourth hinge fold line 114 may be oriented parallel to the first hinge fold line 32. The fourth hinge fold line 114 may be oriented parallel to the third hinge fold line 40.

Figure 9:
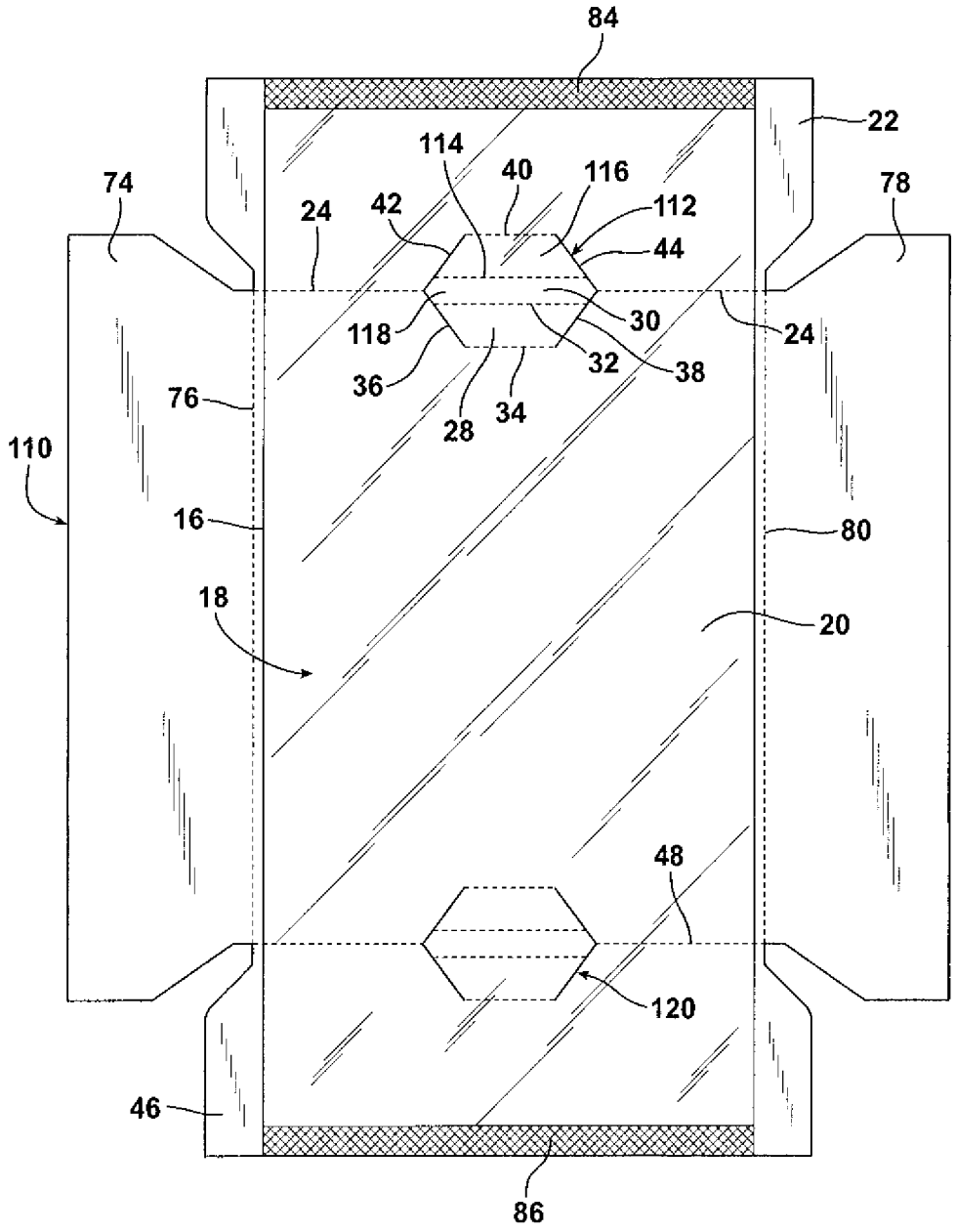
FIG. 9 is a representative top plan view of an alternative embodiment of the packaging structure of the present disclosure in the unfolded, lay-flat configuration.
Figure 10:
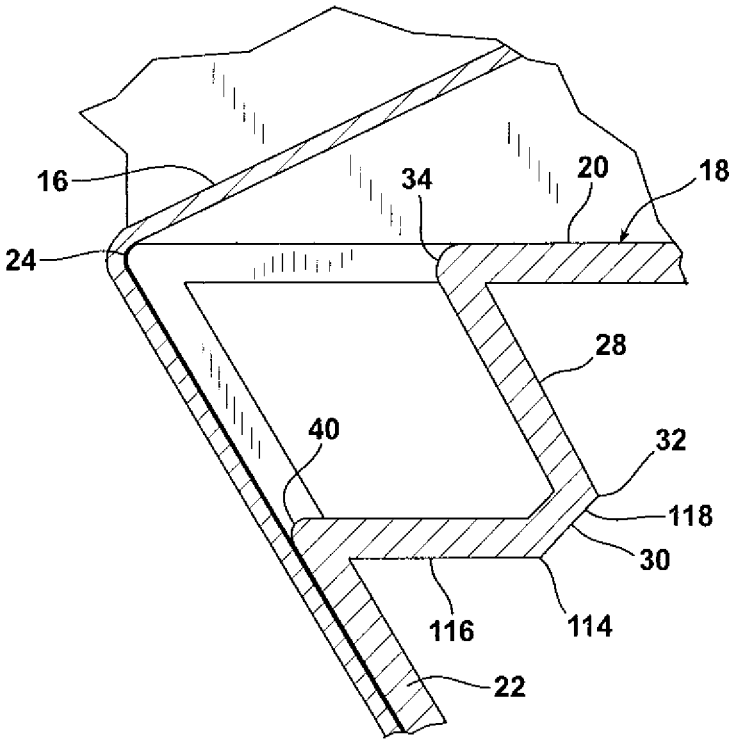
FIG. 10 is a representative sectional detail view of a hinge portion of FIG. 9 in the engaged position.

Packaging structure 110 further comprises supplemental end flap portion 46 and supplemental hinge portion 120 corresponding to supplemental end flap fold line 48 that foldably connects the platform portion and supplemental end flap portion, where the supplemental hinge portion 120 is between the supplemental end flap portion 46 and platform portion 18. (FIG. 9.) The supplemental hinge portion 120 may have a structure corresponding to hinge portion 112 as illustrated in FIG. 9.

FIGS. 11-12

In another embodiment of the hinge portion (referring to packaging structure 70 of FIGS. 11-12), hinge portion 72 comprises top and bottom hinge sections 28, 30 foldably connected to each other along first hinge fold line 32 between the top and bottom hinge sections. The hinge portion 72 is bordered by: (i) second hinge fold line 34 between platform portion 18 and top hinge section 28, (ii) top hinge cut line 36 between the platform portion 18 and the top hinge section 28 extending from the end flap fold line 24 to the second hinge fold line 34, (iii) third hinge fold line 40 between the end flap portion 22 and bottom hinge section 30, and (iv) bottom hinge cut line between the end flap portion 22 and the bottom hinge section 30 extending from the end flap fold line 24 to the third hinge fold line 40.

In this embodiment, however, the second hinge fold line 34 is not oriented parallel to the first hinge fold line 32; rather, the second hinge fold line 34 extends from end flap fold line 24 to first top hinge cut line 36. Further, the third hinge fold line 40 is not oriented parallel to the first hinge fold line 32; rather, the third hinge fold line 40 extends from end flap fold line 24 to first bottom hinge cut line 42. The top hinge section 28 has a triangular shape and the bottom hinge section 30 has a triangular shape.

Figure 11:
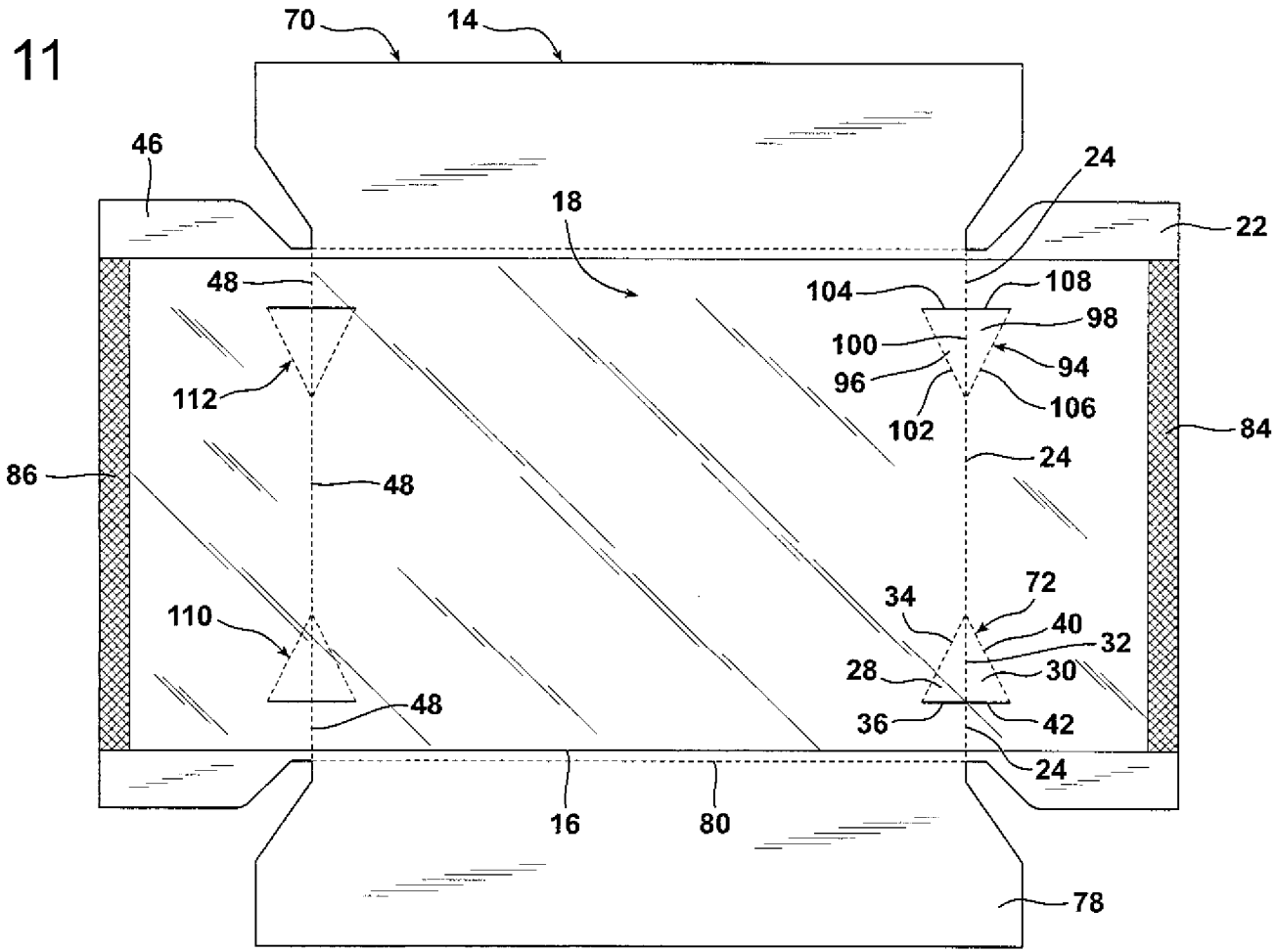
FIG. 11 is a representative top plan view of another alternative embodiment of the packaging structure of the present disclosure in the unfolded, lay-flat configuration.
Figure 12:
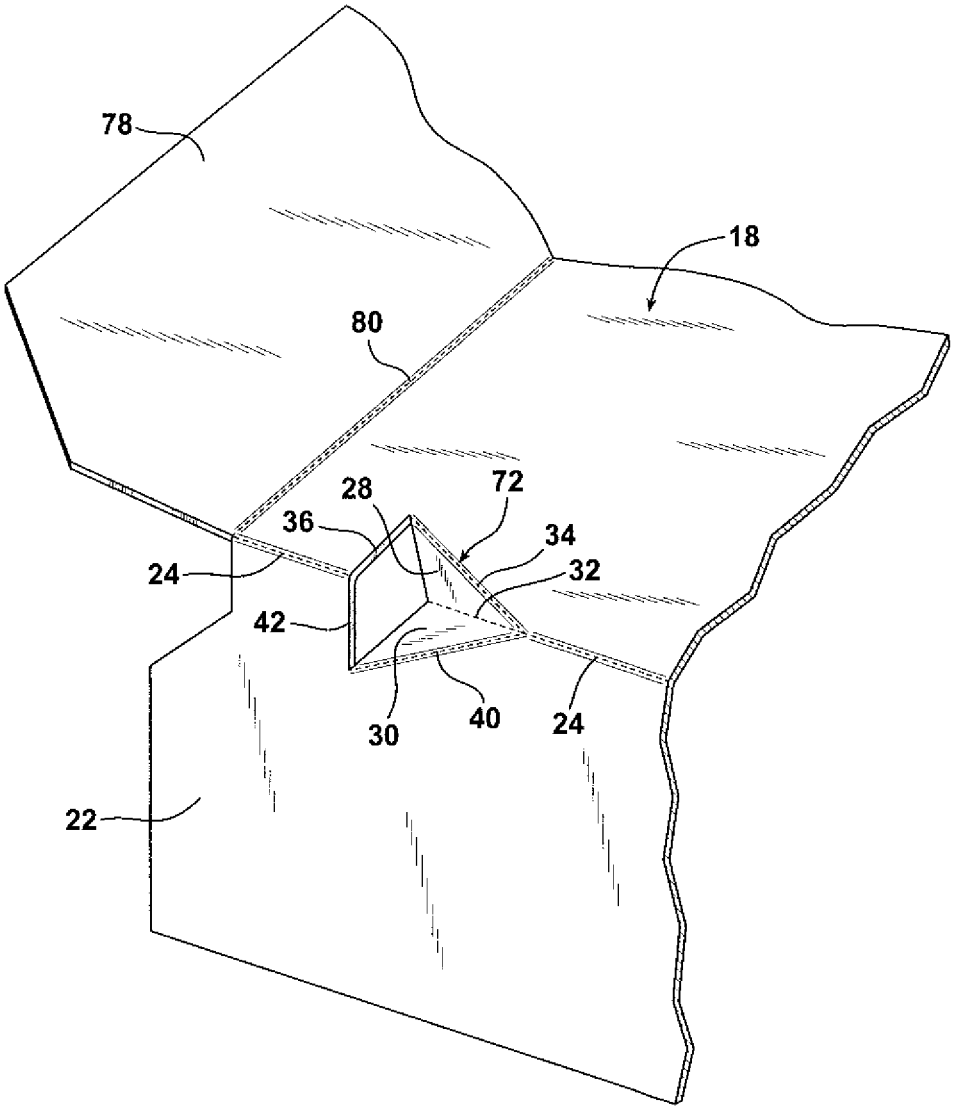
FIG. 12 is a representative perspective detail view of the packaging structure of FIG. 11 in a folded condition.

In another aspect of the presently disclosed subject matter, the packaging structure may comprise more than one hinge portion corresponding to the same hinge fold line. For example packaging structure 70, as illustrated in FIGS. 11-12, comprises hinge portion 72 and auxiliary hinge portion 94 corresponding to the same hinge fold line 24. The more than one hinge portions may comprise any combination of the hinge portions that are described herein.

Auxiliary hinge portion 94 comprises auxiliary top hinge section 96 and auxiliary bottom hinge section 98 foldably connected to each other along auxiliary first hinge fold line 100 between the auxiliary top and auxiliary bottom hinge sections 96, 98. The auxiliary hinge portion 94 is bordered by: (i) an auxiliary second hinge fold line between the platform portion 18 and the auxiliary top hinge section 96, for example, auxiliary second hinge fold line 102 extending from end flap fold line 24 to first auxiliary top hinge cut line 104, (ii) at least one auxiliary top hinge cut line 104 between the platform portion 18 and the auxiliary top hinge section 96 and extending from the end flap fold line 24 to the auxiliary second hinge fold line 102, (iii) an auxiliary third hinge fold line between the end flap portion 22 and the auxiliary bottom hinge section 98, for example auxiliary third hinge fold line 106 extending from end flap fold line 24 to first auxiliary bottom hinge cut line 108, and (iv) at least one auxiliary bottom hinge cut line 108 between the end flap portion 22 and the auxiliary bottom hinge section 96 and extending from the end flap fold line 24 to the auxiliary third hinge fold line 106.

Packaging structure 70 further comprises supplemental end flap portion 46 and supplemental hinge portions 110 and 112 both corresponding to supplemental end flap fold line 48 that foldably connects the platform portion and supplemental end flap portion, where the supplemental hinge portions 110 and 112 are both between the supplemental end flap portion 46 and platform portion 18. (FIG. 11.)

Packaging Structure Engaged Position

The packaging structures are the present disclosure are foldable from, for example, a lay-flat, unfolded position (e.g., FIGS. 2-3, 6, 9, 11), to an engaged position (e.g., FIGS. 1, 5, 7-8, 13) in which, in reference to FIGS. 1, 5, and 7-8:

(i) the end flap portion 22 is folded along the end flap fold line 24 away from the support surface 20 of the platform portion 18 to define an acute angle 92 between the platform portion 18 and the end flap portion 22; and (ii) the hinge portion is folded along the first hinge fold line 32, second hinge fold line 34, and third hinge fold line 40 to separate the top hinge section 28 and platform portion 18 along at least one top hinge cut line, for example, along first top hinge cut line 36 and along second top hinge cut line 38, and separate the bottom hinge section 30 and the end flap portion 22 along at least one bottom hinge cut line, for example, along first bottom hinge cut line 42 and along second bottom hinge cut line 44, to extend the top and bottom hinge sections 28, 30 within the acute angle 92 between the platform portion 18 and the end flap portion 22.

The packaging structure may be further foldable to the engaged position in which in reference to FIGS. 1, 5, and 7-8:

(i) the supplemental end flap portion 46 is folded along the supplemental end flap fold line 48 away from the support surface 20 of the platform portion 18 to define an acute angle 92 between the platform portion 18 and the supplemental end flap portion 46; and (ii) the supplemental hinge portion is folded along the supplemental first hinge fold line 56, supplemental second hinge fold line 58, and supplemental third hinge fold line 64 to separate the supplemental top hinge section 52 and platform portion 18 along at least one supplemental top hinge cut line, for example, along supplemental first top hinge cut line 60 and along supplemental second top hinge cut line 62, and separate the supplemental bottom hinge section 54 and the supplemental end flap portion 46 along at least one supplemental bottom hinge cut line, for example, along supplemental first bottom hinge cut line 66 and along supplemental second bottom hinge cut line 68, to extend the supplemental top and supplemental bottom hinge sections 52, 54 within the acute angle 92 between the platform portion 18 and the supplemental end flap portion 46.

Figure 5:
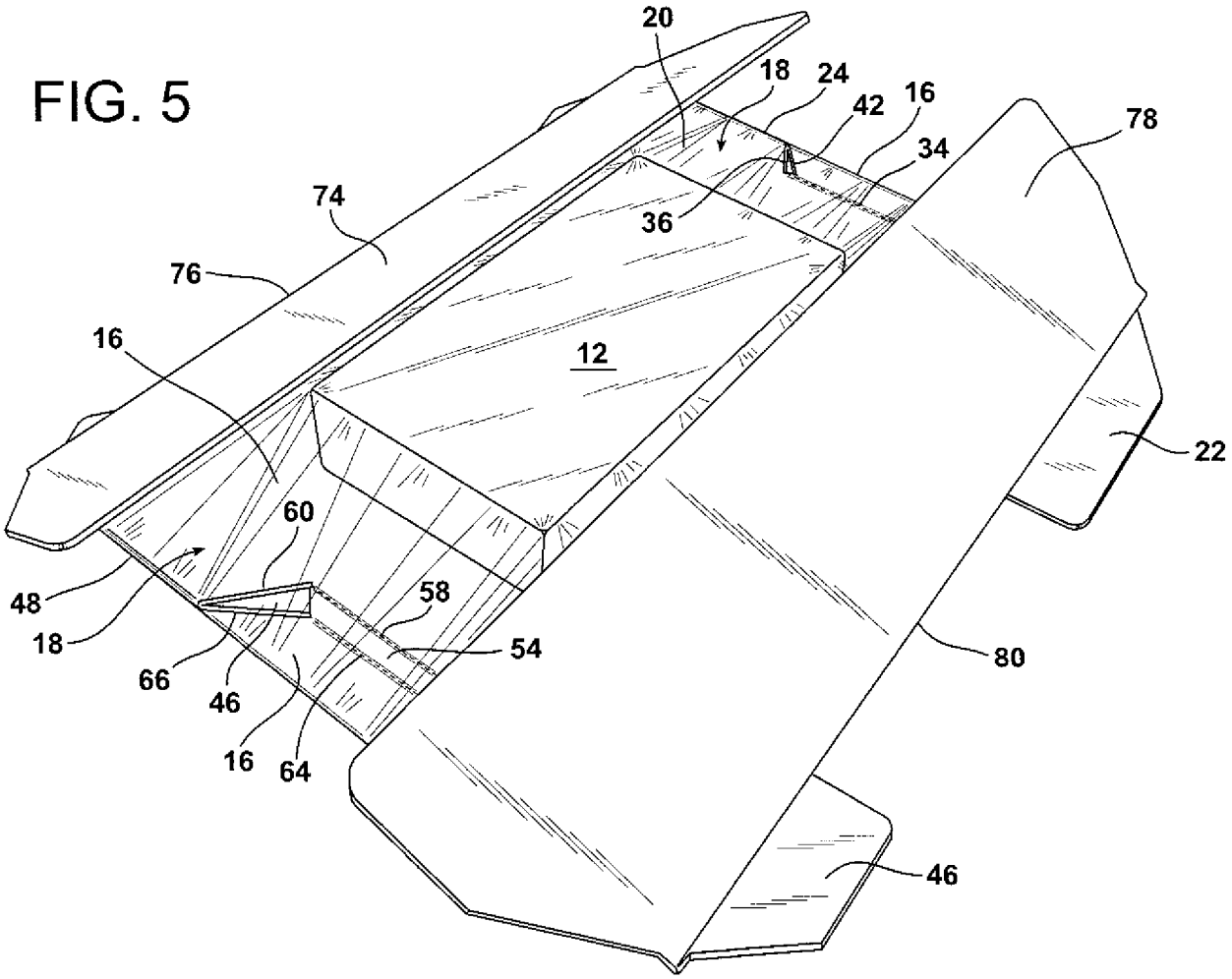
FIG. 5 is a representative perspective view of the packaging structure of FIG. 4 in the engaged position retaining the object.
Figure 6:
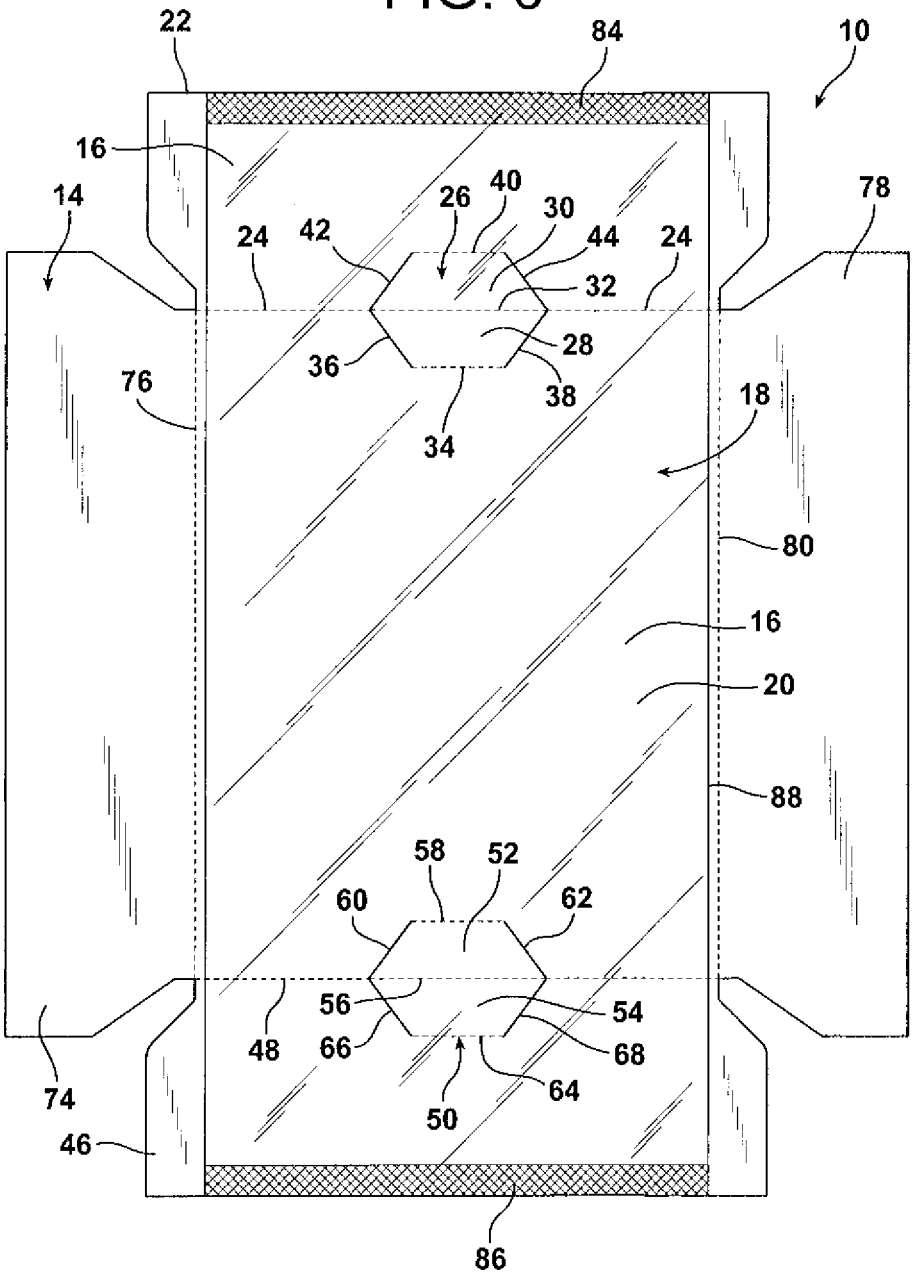
FIG. 6 is a representative top plan view of the packaging structure of FIG. 1 in an unfolded, lay-flat position before insertion of the object to be packaged.
Figure 7:
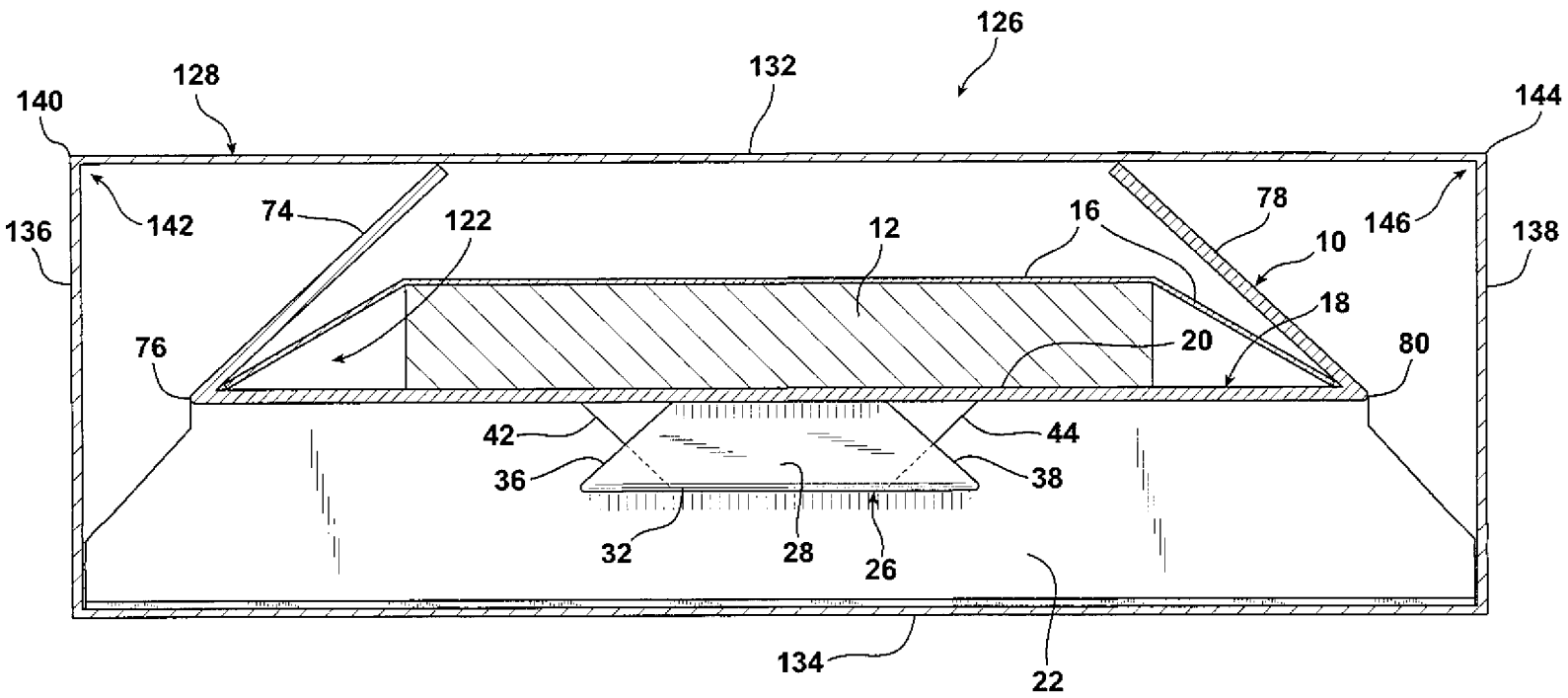
FIG. 7 is a representative cross-sectional view of taken along the line 7-7 of FIG. 1 where the packaging structure is also positioned in a box.
Figure 8:
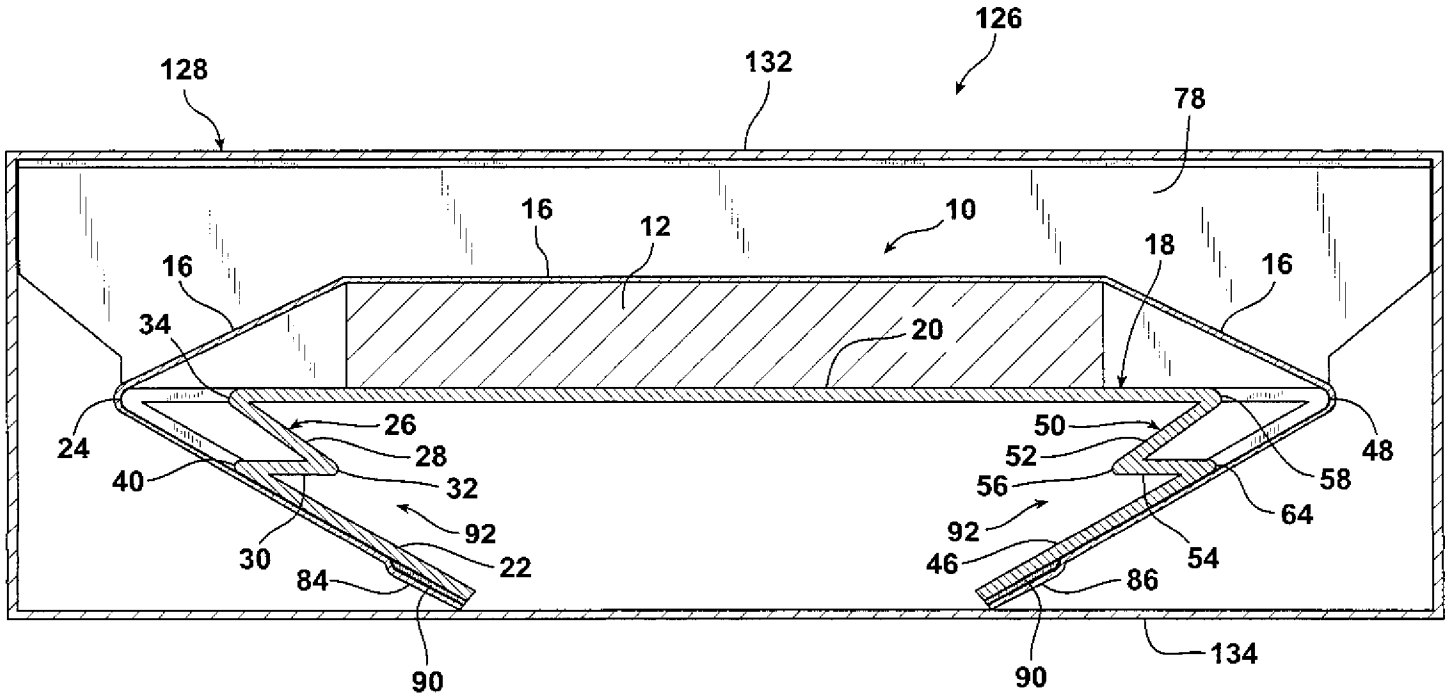
FIG. 8 is a representative cross-sectional view taken along the line 8-8 of FIG. 1 where the packaging structure is also positioned in a box.

In engaged positions of the packaging structure, the film 16 may be tensioned to restrain object 12 between the film 16 and the platform portion 18. (FIGS. 5, 7-8.)

Figure 13:
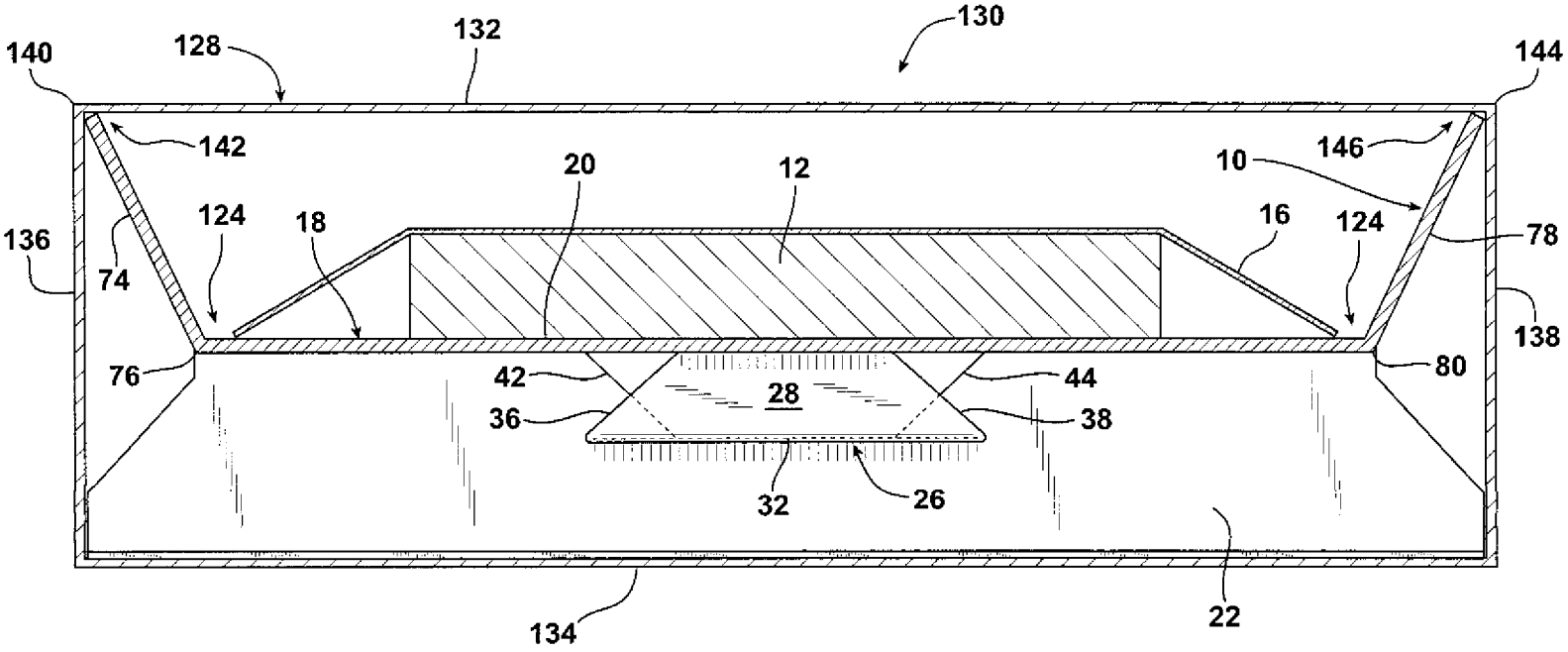
FIG. 13 is a representative sectional view of an alternative packaging assembly of the present disclosure similar to FIG. 7, but having the side flaps engage the corner edge of the box.

In the engaged position, the side flap portion 74 may be folded along the corresponding side flap fold lines 76 toward the support surface 20 of the platform portion 18 and the supplemental side flap portion 78 may be folded along the supplemental side flap fold line 80 toward the support surface 20 of the platform portion 18. The side flap portion 74 and supplemental side flap portion 78 may be folded so that one or both form an acute angle 122 with respect to the platform portion 18, for example, as illustrated in FIG. 7. Alternatively, in the engaged position, the side flap portion 74 and supplemental side flap portion 78 may be folded so that one or both form an obtuse angle 124 with respect to the platform portion 18, for example, as illustrated in FIG. 13.

Packaging Assembly

A packaging assembly may comprise a box and any of the packaging structures described herein installed in the box, for example, when the packaging structure is in the engaged position.

For example, the packaging assembly 126 (FIGS. 7-8) has packaging structure 10 installed in box 128 in the engaged position and restraining object 12. The box 128 has interior dimensions corresponding to the packaging structure 10 to hold the packaging structure in the engaged position within the box. The box has opposing top wall 132 and bottom wall 134 and opposing first side wall 136 and second side wall 138 extending between the top and bottom walls. The top wall 132 and the first side wall 136 meet along a first edge 140 to form a first corner edge 142 of the box 128. The top wall 132 and the second side wall 138 meet along a second edge 144 to form a second corner edge 146 of the box 128.

As seen in FIG. 7, the top wall 132 maintains the side flap portion 74 and the supplemental side flap portion 78 in an engaged position forming an acute angle 122 with respect to platform portion 18.

Alternatively, as seen in FIG. 13 for packaging assembly 130, the top wall 132 maintains the side flap portion 74 and the supplemental side flap portion 78 in an engaged position forming an obtuse angle 124 with respect to platform portion 18. In this engaged position configuration, the side flap portion 74 extends to engage the first corner edge 142 of the box 128; and the supplemental side flap portion 78 extends to engage the second corner edge 146 of the box 128. As such, the side flap portion 74 and supplemental side flap portion 78 may act to help brace the engaged packaging structure 10 within box 128.

In any of the packaging assembly embodiments, the packaging structure may be installed in the engaged position within the box to maintain any of the end flap portion, supplemental end flap portion, side flap portion, and supplemental side flap portion in an engaged position. (FIGS. 7-8, 13.) The flap portions in the engaged position may have a tendency or bias to move back toward the pre-folded, lay-flat position, if unrestrained, due to the inherent characteristics of the material from which panel 14 is made. The walls of the box enclose the packaging assembly to prevent the movement of the flap portions past the walls, thereby restraining the flap portions to maintain them in the engaged positions.

Box 128 as illustrated comprises a polyhedron-shaped storage compartment, in which the side walls, bottom wall, and top wall (i.e., closure flaps) are polygon-shaped (e.g., rectangular). Useful box types are known to those of skill in the field, and include containers of the RSC (regular slotted container) type, RELF (roll end lock front) type, RETT (roll and end tuck top) type, and STE (standard tuck end) type.

Film Materials and Attributes

Film 16 may have a composition and thickness providing acceptable performance properties (e.g., flexibility, elasticity, optics, strength) for the given packaging application of expected use. The film may have a thickness of at most any of the following: 10 mils, 6 mils, 5 mils, 4 mils, 3 mils, 2 mils, 1.5 mils, and 1 mil. (A "mil" is equal to 0.001 inch.) The film may also have a thickness of at least any of the following: 0.5 mils, 1 mil, 1.5 mils, 2 mils, and 3 mils.

The film may have an elastic recovery in either or both of the transverse and longitudinal directions of at least any of the following values: 60%, 65%, 70%, 75%, 80%, and 85%, measured according to ASTM D5459 at 100% strain, 30 seconds relaxation time, and 60 second recovery time.

The film may have a maximum load tear resistance in either or both of the transverse and longitudinal directions of at least about any of the following values: 400, 450, 500, 550, and 600 grams force, measured according to ASTM D1004.

The film may have a slow puncture maximum load of at least about any of the following values: 4, 4.5, 5, 5.5, 6, 6.5, and 7 pounds force, measured according to ASTM F1306 using a crosshead speed of 5 inches per minute.

The film may have a Young's modulus sufficient to withstand the expected handling and use conditions, yet may provide a "soft" feel that may be desirable for a packaging application. The film may have a Young's modulus of at least any of the following values: 2,000; 2,500; 3,000; 3,500; and 4,000 pounds/square inch. The film may have a Young's modulus of at most any of the following values: 8,000;

10,000; 15,000; 20,000; 30,000; and 40,000 pounds/square inch. The Young's modulus is measured in accordance with ASTM D882, measured at a temperature of 73° F.

The film may be transparent so that the packaged article (e.g., product 8) may be visible through the film. "Transparent" as used herein means that the material transmits incident light with negligible scattering and little absorption, enabling objects to be seen clearly through the material under typical unaided viewing conditions (i.e., the expected use conditions of the material). The transparency (i.e., clarity) of the film may be at least about any of the following values: 65%, 70%, 75%, 80%, 85%, and 90%, measured in accordance with ASTM D1746.

The film may have a heat-shrink attribute. For example, the film may have any of a free shrink in at least one direction (i.e., machine or transverse directions), in each of at least two directions (i.e., machine and transverse directions), measured at any of 160° F. and 180° F. of at least any of the following: 7%, 10%, 15%, 20%, 25%, 30%, 40%, 50%, 55%, 60%, and 65%. Alternatively, the film may be non-heat shrinkable (i.e., has a total free shrink of less than 5% measured at 160° F.). Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

The film may comprise, for example, one or more fabrics, such as one or more of the following: wovens, knits, nonwovens, and openwork meshes (e.g., netting), spandex, including Lycra® brand spandex, and elastic fabrics.

The film may comprise one or more polymers, for example, one or more of any of the following polymers: thermoplastic polymers, polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth)acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethane (i.e., any one or more of polyurethane, polyether polyurethane, polyester polyurethane, and polycarbonate polyurethane, any of which may be aliphatic and/or aromatic). The film may also comprise thermoplastic polyolefin elastomers (TPOs), which are two-component elastomer systems comprising an elastomer (such as EPDM) finely dispersed in a thermoplastic polyolefin (such as polypropylene or polyethylene). "Copolymer" as used in this application means a polymer derived from two or more types of monomers, and includes terpolymers, etc.

A film comprising polyolefin (e.g., polyethylene), polyvinyl chloride, and/or polyurethane may be useful for lightweight applications, for example, where a sheet thickness of from 2 to 4 mils may be desirable. A film comprising polyurethane may provide desirable elastomeric, puncture resistance, temperature resistance, and tackiness characteristics.

The film may comprise effective amounts of one or more of tackifiers, antiblocking agents, and slip agents—or may be essentially free of any of these components. Tackifiers, antiblocking agents, and slip agents, and their effective amounts, are known to those of ordinary skill in the art.

The film may be manufactured by thermoplastic film-forming processes known in the art (e.g., tubular or blown-film extrusion, coextrusion, extrusion coating, flat or cast film extrusion). A combination of these processes may also be employed.

At least one side of the film may be corona and/or plasma treated to change the surface energy of the sheet, for example, to increase the ability of the film to adhere to a panel.

Films that may be useful are described in U.S. Pat. No. 6,913,147 issued Jul. 5, 2005 and entitled "Packaging Structure Having a Frame and Film," which is incorporated herein in its entirety by reference.

The films of any of the embodiments described herein may comprise any of the materials, thicknesses, compositions, and other characteristics as described herein with respect to film 16.

Manufacture of the Packaging Structure

By using types of machinery well known to those of skill in the field, the panel 14 may be cut to the desired shapes and provided with fold lines or cut lines, using the known types of machinery, for example, to cut, slit, crease, crimp, emboss, perforate, scored, or otherwise weaken the panel desired regions. The adhesive 90 may be applied to the panel 14 in selected areas. The film 16 may be laminated to the panel 14 by adhering the sheets with adhesive 90 to the panel using methods known in the art.

Use of the Packaging Assembly

In the use of the packaging assembly, the packaging structure may be provided in the lay-flat configuration, as shown in FIG. 2. Object 12 to be packaged may be placed between the film and the platform portion 18 of any of the embodiments of the packaging structure described herein. The packaging structure may then be placed in the engaged position, as described herein, to tension the film and restrain the object between the film and platform portion. The packaging structure restraining the object may then be placed within a box to retain the packaging structure in the engaged position.

Various Embodiments of the Disclosed Subject Matter

The following sentences set forth various embodiments of the disclosed subject matter.

A. A packaging structure for restraining an object, the structure comprising:

a panel comprising:

a platform portion having a support surface for supporting the object;

an end flap portion foldably connected to the platform portion along an end flap fold line; and a hinge portion comprising top and bottom hinge sections foldably connected to each other along a first hinge fold line between the top and bottom hinge sections, wherein the hinge portion is bordered by:

a second hinge fold line between the platform portion and the top hinge section;

at least one top hinge cut line between the platform portion and the top hinge section and extending from the end flap fold line to the second hinge fold line;

a third hinge fold line between the end flap portion and the bottom hinge section; and at least one bottom hinge cut line between the end flap portion and the bottom hinge section and extending from the end flap fold line to the third hinge fold line; and a film extending across the end flap fold line and attached to the end flap portion and attached to the panel outside of the end flap portion;

wherein the packaging structure is foldable to an engaged position having:

the end flap portion folded along the end flap fold line away from the support surface of the platform portion to define an acute angle between the platform portion and the end flap portion; and the hinge portion folded along the first, second, and third hinge fold lines to separate the top hinge section and the platform portion along the at least one top hinge cut line, separate the bottom hinge section and the end flap portion along the at least one bottom hinge cut line, and extend the top and bottom hinge sections within the acute angle between the platform portion and the end flap portion.

B. The packaging structure of sentence A wherein the film has at least one edge portion of the film unconnected to the platform portion whereby the object may be inserted between the film and the platform portion.

C. The packaging structure of any one of the previous sentences wherein in the engaged position the film is tensioned to restrain the object supported between the film and the platform portion.

D. The packaging structure of any one of the previous sentences wherein:

the at least one top hinge cut line comprises:

a first top hinge cut line between the platform portion and the top hinge section and extending from the end flap fold line to the second hinge fold line; and a second top hinge cut line between the platform portion and the top hinge section and extending from the end flap fold line to the second hinge fold line; and the at least one bottom hinge cut line comprises:

a first bottom hinge cut line between the end flap portion and the bottom hinge section and extending from the end flap fold line to the third hinge fold line; and a second bottom hinge cut line between the end flap portion and the bottom hinge section and extending from the end flap fold line to the third hinge fold line; and in the engaged position the hinge portion is folded to separate the top hinge section and the platform portion along the first and second top hinge cut lines and to separate the bottom hinge section and the end flap portion along the first and second bottom hinge cut lines.

E. The packaging structure of any one of the previous sentences wherein;

the first hinge fold line is oriented parallel to the second hinge fold line; and the third hinge fold line is oriented parallel to the second hinge fold line.

F. The packaging structure of any one of the previous sentences wherein:

the panel further comprises:

a supplemental end flap portion foldably connected to the platform portion along a supplemental end flap fold line oriented on an end of the platform portion opposite the end flap fold line; and a supplemental hinge portion comprising supplemental top and supplemental bottom hinge sections foldably connected to each other along a supplemental first hinge fold line between the supplemental top and supplemental bottom hinge sections, the supplemental hinge portion bordered by:

a supplemental second hinge fold line between the platform portion and the supplemental top hinge section;

at least one supplemental top hinge cut line between the platform portion and the supplemental top hinge section and extending from the supplemental end flap fold line to the supplemental second hinge fold line;

a supplemental third hinge fold line between the supplemental end flap portion and the supplemental bottom hinge section; and at least one supplemental bottom hinge cut line between the supplemental end flap portion and the supplemental bottom hinge section and extending from the supplemental end flap fold line to the supplemental third hinge fold line; and the film extends across the supplemental end flap fold line and is attached to the supplemental end flap portion; and the packaging structure is further foldable to the engaged position having:

the supplemental end flap portion folded along the supplemental end flap fold line away from the support surface of the platform portion to define an supplemental acute angle between the platform portion and the supplemental end flap portion; and the supplemental hinge portion folded along the supplemental first, supplemental second, and supplemental third hinge fold lines to separate the supplemental top hinge section and the platform portion along the at least one supplemental top hinge cut line, separate the supplemental bottom hinge section and the supplemental end flap portion along the at least one supplemental bottom hinge cut line and to extend the supplemental top and supplemental bottom hinge sections within the supplemental acute angle between the platform portion and the supplemental end flap portion.

G. The packaging structure of sentence F wherein the film has at least one edge portion of the film unconnected to the platform portion whereby the object may be inserted between the film and the platform portion.

H. The packaging structure of any one of sentences F and G wherein in the engaged position the film is tensioned to restrain the object supported between the film and the platform portion.

I. The packaging structure of any one of sentences F through H wherein:

the at least one supplemental top hinge cut line comprises:

a supplemental first top hinge cut line between the platform portion and the supplemental top hinge section and extending from the supplemental end flap fold line to the supplemental second hinge fold line; and a supplemental second top hinge cut line between the platform portion and the supplemental top hinge section and extending from the supplemental end flap fold line to the supplemental second hinge fold line; and the at least one supplemental bottom hinge cut line comprises:

a supplemental first bottom hinge cut line between the supplemental end flap portion and the supplemental bottom hinge section and extending from the supplemental end flap fold line to the supplemental third hinge fold line; and a supplemental second bottom hinge cut line between the supplemental end flap portion and the supplemental bottom hinge section and extending from the supplemental end flap fold line to the supplemental third hinge fold line; and in the engaged position the supplemental hinge portion is folded to separate the supplemental top hinge section and the platform portion along the supplemental first and second top hinge cut lines and to separate the supplemental bottom hinge section and the supplemental end flap portion along the supplemental first and second bottom hinge cut lines.

J. The packaging structure of any one of sentences F through I wherein:

the supplemental first hinge fold line is oriented parallel to the supplemental second hinge fold line; and the supplemental third hinge fold line is oriented parallel to the supplemental second hinge fold line.

K. The packaging structure of any one of sentences A through D and F through I wherein:

the second hinge fold line extends from the end flap fold line to the at least one top cut line; and the third hinge fold line extends from the end flap fold line to the at least one bottom hinge cut line.

L. The packaging structure of any one of sentences A through D, F through I, and K wherein:

the top hinge section has a triangular shape; and the bottom hinge section has a triangular shape.

M. The packaging structure of any one of the previous sentences further comprising:

an auxiliary hinge portion comprising auxiliary top and auxiliary bottom hinge sections foldably connected to each other along an auxiliary first hinge fold line between the auxiliary top and auxiliary bottom hinge sections, the auxiliary hinge portion bordered by:

an auxiliary second hinge fold line between the platform portion and the auxiliary top hinge section;

at least one auxiliary top hinge cut line between the platform portion and the auxiliary top hinge section and extending from the end flap fold line to the auxiliary second hinge fold line;

an auxiliary third hinge fold line between the end flap portion and the auxiliary bottom hinge section; and at least one auxiliary bottom hinge cut line between the end flap portion and the auxiliary bottom hinge section and extending from the end flap fold line to the auxiliary third hinge fold line.

N. The packaging structure of any one of the previous sentences wherein the bottom hinge section comprises a first ancillary portion and a second ancillary portion foldably connected to each other along a fourth hinge fold line between the first and third hinge fold lines.

O. The packaging structure of any one of the previous sentences wherein the panel further comprises:

a side flap portion foldably connected to the platform portion by a side flap fold line oriented transverse to the end flap fold line; and a supplemental side flap portion foldably connected to the platform portion by a supplemental side flap fold line oriented transverse to the end flap fold line and on a side of the platform portion opposite the side flap fold line;

wherein in the engaged position the side flap portion is folded along the side flap fold line toward the support surface of the platform portion and the supplemental side flap portion is folded along the supplemental side flap fold line toward the support surface of the platform portion.

P. The packaging structure of sentence O wherein in the engaged position the side flap portion forms an obtuse angle between the platform portion and the side flap portion and the supplemental side flap portion forms a supplemental obtuse angle between the platform portion and the supplemental side flap portion.

Q. A packaging assembly comprising:

a box having opposing top and bottom walls and opposing first and second side walls extending between the top and bottom walls, wherein the top wall and the first side wall meet along a first edge to form a first corner edge of the box and the top wall and the second side wall meet along a second edge to form a second corner edge of the box; and the packaging structure of sentence P in the engaged position, wherein the side flap portion extends to engage the first corner edge of the box and the supplemental side flap portion extends to engage the second corner edge of the box.

R. A packaging assembly comprising:

the packaging structure of any one of the sentences A through P in the engaged position; and a box having interior dimensions corresponding to the packaging structure in the engaged position to hold the packaging structure in the engaged position within the box.

S. A method of packaging an object comprising:

inserting an object between the film and the platform portion of the packaging structure of any one of the previous sentences; and placing the packaging structure in the engaged position to tension the film and restrain the object between the film and the platform portion.

T. The method of sentence S further comprising placing the packaging structure restraining the object into a box to retain the packaging structure in the engaged position.

Any numerical value ranges recited herein include all values from the lower value to the upper value in increments of one unit provided that there is a separation of at least 2 units between any lower value and any higher value. As an example, if it is stated that the amount of a component or a value of a process variable (e.g., temperature, pressure, time) may range from any of 1 to 90, 20 to 80, or 30 to 70, or be any of at least 1, 20, or 30 and/or at most 90, 80, or 70, then it is intended that values such as 15 to 85, 22 to 68, 43 to 51, and 30 to 32, as well as at least 15, at least 22, and at most 32, are expressly enumerated in this specification. For values that are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

The above descriptions are those of various and/or preferred embodiments of the invention. Various alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. The definitions and disclosures set forth in the present Application control over any inconsistent definitions and disclosures that may exist in an incorporated reference. All references to ASTM tests are to the most recent, currently approved, and published version of the ASTM test identified, as of the priority filing date of this application. Each such published ASTM test method is incorporated herein in its entirety by this reference.

What is claimed is:

1. A packaging structure for restraining an object, the structure comprising:

a panel comprising:

a platform portion having a support surface for supporting the object;

an end flap portion foldably connected to the platform portion along an end flap fold line; and a hinge portion comprising top and bottom hinge sections foldably connected to each other along a first hinge fold line between the top and bottom hinge sections, wherein the hinge portion is bordered by:

a second hinge fold line between the platform portion and the top hinge section;

at least one top hinge cut line between the platform portion and the top hinge section and extending from the end flap fold line to the second hinge fold line;

a third hinge fold line between the end flap portion and the bottom hinge section; and at least one bottom hinge cut line between the end flap portion and the bottom hinge section and extending from the end flap fold line to the third hinge fold line; and a film extending across the end flap fold line and attached to the end flap portion and attached to the panel outside of the end flap portion;

wherein the packaging structure is in an engaged position having:

the end flap portion folded along the end flap fold line away from the support surface of the platform portion to define an acute angle between the platform portion and the end flap portion; and the hinge portion folded along the first, second, and third hinge fold lines to separate the top hinge section and the platform portion along the at least one top hinge cut line, separate the bottom hinge section and the end flap portion along the at least one bottom hinge cut line, and extend the top and bottom hinge sections within the acute angle between the platform portion and the end flap portion;

wherein the film is tensioned to restrain the object supported between the film and the platform portion.

2. The packaging structure of claim 1 wherein the film has at least one edge portion of the film unconnected to the platform portion.

3. The packaging structure of claim 1 wherein:

the at least one top hinge cut line comprises:

a first top hinge cut line between the platform portion and the top hinge section and extending from the end flap fold line to the second hinge fold line; and a second top hinge cut line between the platform portion and the top hinge section and extending from the end flap fold line to the second hinge fold line; and the at least one bottom hinge cut line comprises:

a first bottom hinge cut line between the end flap portion and the bottom hinge section and extending from the end flap fold line to the third hinge fold line; and a second bottom hinge cut line between the end flap portion and the bottom hinge section and extending from the end flap fold line to the third hinge fold line; and in the engaged position the hinge portion is folded to separate the top hinge section and the platform portion along the first and second top hinge cut lines and to separate the bottom hinge section and the end flap portion along the first and second bottom hinge cut lines.

4. The packaging structure of claim 1 wherein;

the first hinge fold line is oriented parallel to the second hinge fold line; and the third hinge fold line is oriented parallel to the second hinge fold line.

5. The packaging structure of claim 1 wherein:

the panel further comprises:

a supplemental end flap portion foldably connected to the platform portion along a supplemental end flap fold line oriented on an end of the platform portion opposite the end flap fold line; and a supplemental hinge portion comprising supplemental top and supplemental bottom hinge sections foldably connected to each other along a supplemental first hinge fold line between the supplemental top and supplemental bottom hinge sections, the supplemental hinge portion bordered by:

a supplemental second hinge fold line between the platform portion and the supplemental top hinge section;

at least one supplemental top hinge cut line between the platform portion and the supplemental top hinge section and extending from the supplemental end flap fold line to the supplemental second hinge fold line;

a supplemental third hinge fold line between the supplemental end flap portion and the supplemental bottom hinge section; and at least one supplemental bottom hinge cut line between the supplemental end flap portion and the supplemental bottom hinge section and extending from the supplemental end flap fold line to the supplemental third hinge fold line; and the film extends across the supplemental end flap fold line and is attached to the supplemental end flap portion;

wherein the packaging structure is in the engaged position further having:

the supplemental end flap portion folded along the supplemental end flap fold line away from the support surface of the platform portion to define an supplemental acute angle between the platform portion and the supplemental end flap portion; and the supplemental hinge portion folded along the supplemental first, supplemental second, and supplemental third hinge fold lines to separate the supplemental top hinge section and the platform portion along the at least one supplemental top hinge cut line, separate the supplemental bottom hinge section and the supplemental end flap portion along the at least one supplemental bottom hinge cut line and to extend the supplemental top and supplemental bottom hinge sections within the supplemental acute angle between the platform portion and the supplemental end flap portion.

6. The packaging structure of claim 5 wherein the film has at least one edge portion of the film unconnected to the platform portion.

7. The packaging structure of claim 5 wherein:

the at least one supplemental top hinge cut line comprises:

a supplemental first top hinge cut line between the platform portion and the supplemental top hinge section and extending from the supplemental end flap fold line to the supplemental second hinge fold line; and a supplemental second top hinge cut line between the platform portion and the supplemental top hinge section and extending from the supplemental end flap fold line to the supplemental second hinge fold line; and the at least one supplemental bottom hinge cut line comprises:

a supplemental first bottom hinge cut line between the supplemental end flap portion and the supplemental bottom hinge section and extending from the supplemental end flap fold line to the supplemental third hinge fold line; and a supplemental second bottom hinge cut line between the supplemental end flap portion and the supplemental bottom hinge section and extending from the supplemental end flap fold line to the supplemental third hinge fold line; and in the engaged position the supplemental hinge portion is folded to separate the supplemental top hinge section and the platform portion along the supplemental first and second top hinge cut lines and to separate the supplemental bottom hinge section and the supplemental end flap portion along the supplemental first and second bottom hinge cut lines.

8. The packaging structure of claim 5 wherein:

the supplemental first hinge fold line is oriented parallel to the supplemental second hinge fold line; and the supplemental third hinge fold line is oriented parallel to the supplemental second hinge fold line.

9. The packaging structure of claim 1 wherein:

the second hinge fold line extends from the end flap fold line to the at least one top cut line; and the third hinge fold line extends from the end flap fold line to the at least one bottom hinge cut line.

10. The packaging structure of claim 9 wherein:

the top hinge section has a triangular shape; and the bottom hinge section has a triangular shape.

11. The packaging structure of claim 1 further comprising:

an auxiliary hinge portion comprising auxiliary top and auxiliary bottom hinge sections foldably connected to each other along an auxiliary first hinge fold line between the auxiliary top and auxiliary bottom hinge sections, the auxiliary hinge portion bordered by:

an auxiliary second hinge fold line between the platform portion and the auxiliary top hinge section;

at least one auxiliary top hinge cut line between the platform portion and the auxiliary top hinge section and extending from the end flap fold line to the auxiliary second hinge fold line;

an auxiliary third hinge fold line between the end flap portion and the auxiliary bottom hinge section; and at least one auxiliary bottom hinge cut line between the end flap portion and the auxiliary bottom hinge section and extending from the end flap fold line to the auxiliary third hinge fold line.

12. The packaging structure of claim 1 wherein the bottom hinge section comprises a first ancillary portion and a second ancillary portion foldably connected to each other along a fourth hinge fold line between the first and third hinge fold lines.

13. The packaging structure of claim 1 wherein the panel further comprises:

a side flap portion foldably connected to the platform portion by a side flap fold line oriented transverse to the end flap fold line; and a supplemental side flap portion foldably connected to the platform portion by a supplemental side flap fold line oriented transverse to the end flap fold line and on a side of the platform portion opposite the side flap fold line;

wherein in the engaged position the side flap portion is folded along the side flap fold line toward the support surface of the platform portion and the supplemental side flap portion is folded along the supplemental side flap fold line toward the support surface of the platform portion.

14. The packaging structure of claim 13 wherein in the engaged position the side flap portion forms an obtuse angle between the platform portion and the side flap portion and the supplemental side flap portion forms a supplemental obtuse angle between the platform portion and the supplemental side flap portion.

15. A packaging assembly comprising:

a box having opposing top and bottom walls and opposing first and second side walls extending between the top and bottom walls, wherein the top wall and the first side wall meet along a first edge to form a first corner edge of the box and the top wall and the second side wall meet along a second edge to form a second corner edge of the box; and the packaging structure of claim 14 in the engaged position, wherein the side flap portion extends to engage the first corner edge of the box and the supplemental side flap portion extends to engage the second corner edge of the box.

16. A packaging assembly comprising:

the packaging structure of claim 13 in the engaged position; and a box having interior dimensions corresponding to the packaging structure in the engaged position to hold the packaging structure in the engaged position within the box.

17. A packaging assembly comprising:

the packaging structure of claim 1 in the engaged position; and a box having interior dimensions corresponding to the packaging structure in the engaged position to hold the packaging structure in the engaged position within the box.

18. A method of packaging an object comprising:

placing the packaging structure of claim 1 into a box to retain; and the packaging structure in the engaged position.

19. A method of packaging an object comprising placing the packaging structure of claim 5 restraining the object into a box to retain the packaging structure in the engaged position.

* * * * *